US006324985B1

(12) United States Patent
Petrusha

(10) Patent No.: US 6,324,985 B1
(45) Date of Patent: Dec. 4, 2001

(54) LOW TEMPERATURE SOLID STATE BONDING OF TUNGSTEN TO OTHER METALLIC MATERIALS

(75) Inventor: Robert L. Petrusha, Sunnyvale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/391,367

(22) Filed: Sep. 8, 1999

(51) Int. Cl.[7] ..... F42B 10/00
(52) U.S. Cl. ..... 102/514; 102/518; 29/1.23
(58) Field of Search ..... 29/1.23; 228/262.6; 102/514, 515, 516, 517, 518, 519

(56) References Cited

U.S. PATENT DOCUMENTS 4,241,483 12/1980 Voitas .
4,823,703 4/1989 Donaldson .
5,352,526 10/1994 Solanki et al. .
5,440,995 8/1995 Levitt .
5,880,382 3/1999 Fang et al. .
5,988,488 * 11/1999 Slattery et al. ..... 228/262.6

* cited by examiner

*Primary Examiner*—Peter M. Poon
*Assistant Examiner*—Timothy D. Collins
(74) *Attorney, Agent, or Firm*—Swidler Berlin Shereff Friedman, LLP

(57) ABSTRACT

A penetrator and method of making same are disclosed. The penetrator includes a tungsten ballast and a steel casing having a bore sized to fit the tungsten ballast therein. Copper and silver coatings are provided on mating surfaces of the tungsten ballast and the steel casing. The tungsten ballast is fitted within the bore of the steel casing to form an assembly, and the assembly is pressurized at a pressure and temperature sufficient to form a low temperature solid state diffusion bond between the tungsten ballast and the steel casing. The bond temperature is below the final tempering temperature of the steel casing and the melting temperatures of the silver and copper. This process allows bonds to be produced on steels in their fully heat treated condition.

7 Claims, 1 Drawing Sheet

LOW TEMPERATURE SOLID STATE BONDING OF TUNGSTEN TO OTHER METALLIC MATERIALS

BACKGROUND OF THE INVENTION

The present invention relates generally to the field of metallurgy, and more specifically, to low temperature solid state bonding of tungsten to other metallic materials. In particular, tungsten heavy alloy ballasts are bonded to high strength steel penetrator cases by coating the mating surfaces with copper and silver, and then bonding the interface by hot isostatic pressing at relatively low temperatures.

DESCRIPTION OF THE RELATED ART

It is known in the art to ballast a high strength steel penetrator/warhead with an inner core made of tungsten to improve its performance. The extreme loads that are produced at target impact require that the dense tungsten ballast be bonded to the steel case. In some penetrators of the past, a tungsten heavy alloy ballast, known as WHA, was thermo-shrink fit to the inside of a steel penetrator case to secure the ballast to the case. This type of bonding, however, has drawbacks. One is that the bond strength between the WHA ballast and steel case is insufficient, causing separation of the two on impact with a target. Another drawback is the bond strength varied from unit to unit, leading to unpredictability in testing.

An example of a tungsten penetrator is described in U.S. Pat. No. 4,823,703, which issued to Donaldson. An armor penetrating projectile has a core which can be made of tungsten alloy, and an outer sabot which can be made of steel. The core and sabot can be bonded together by shrink fitting, adhesive bonding, brazing, soldering and the like. The sabot can also be formed directly on the core by metallic deposition, superplastic forming, diffusion bonding or fiber reinforced lay-up with resin.

U.S. Pat. No. 5,253,797, which issued to Ferrando et al., describes a composite gun barrel in which a molybdenum sleeve envelops a steel core. The steel and molybdenum surfaces are bonded together by coating one or both surfaces with molten silver nitrate, and then heating the structure beyond the decomposition temperature of the silver nitrate to form a uniform deposit of silver. The molybdenum and steel surfaces are then brought together and sintered to form a diffusion bond between the silver metal layer, and the molybdenum and steel surfaces.

A continuing need exists for improved methods of bonding steel and tungsten to make a variety of products, such as ballasted steel penetrators.

SUMMARY OF THE INVENTION

An object of the present invention is to provide a ballasted steel penetrator which includes a bond between the tungsten ballast and high strength steel case that is strong enough to survive impact with a target.

Another object of the present invention is to provide a method of making a penetrator which can produce a repeatable, testable, strong bond between a WHA ballast and a steel case.

Still another object of the invention is to provide a method of making a composite article having a steel portion bonded to a tungsten portion, in which the high strength (>200 Ksi tensile) steel portion does not weaken or loose strength during bonding.

Yet another object of the present invention is to provide a method of making a composite article in which a tungsten ballast is bonded to a steel case with the case in the fully heat treated condition.

These and other objects of the invention are met by providing a method of making a penetrator which comprises the steps of forming a tungsten ballast, forming a steel casing with a bore sized to fit the tungsten ballast therein, coating mating surfaces of the tungsten ballast and the steel casing with silver and copper, fitting the tungsten ballast within the bore of the steel casing, and subjecting the tungsten ballast and steel casing to a pressure and temperature sufficient to form a diffusion bond between the tungsten ballast and the steel casing, wherein the bond temperature is below the final tempering temperature of the steel casing.

The foregoing features and advantages of the present invention will be further understood upon consideration of the following detailed description of the invention taken in conjunction with the accompanying drawings.

DETAILED DESCRIPTION OF THE PREFERRED EMBODIMENTS

Figure 1:
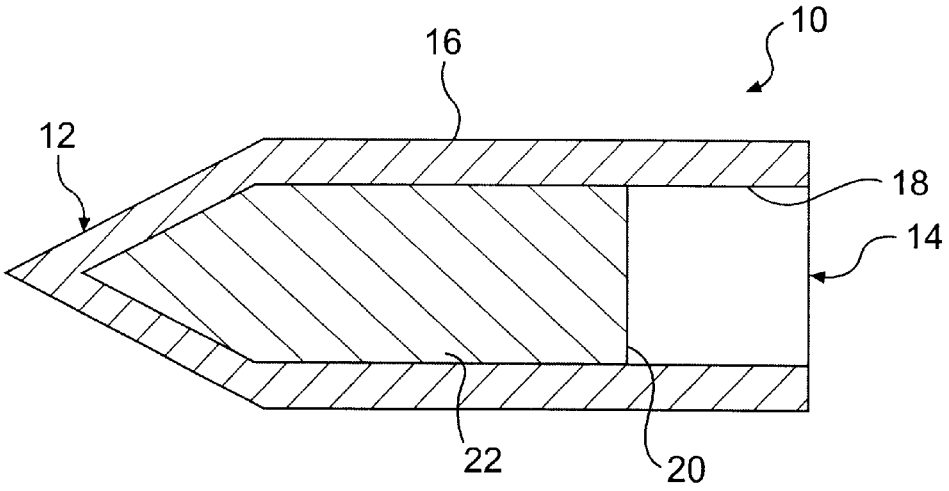
FIG. 1 is a cross sectional view of a penetrator according to a preferred embodiment of the present invention.

Referring to FIG. 1, a penetrator 10 includes an ogive-shaped forward end 12 and an opposite, rearward end 14. The outer dimensions and shape of the penetrator do not form a part of the present invention, and any suitable shapes and dimensions can be employed. The ogive-shape of the forward end functions to facilitate penetration of hard targets, such as bunkers reinforced with steel and concrete.

A high strength steel case 16 includes a central bore 18 into which is fitted a tungsten ballast 20. The bore 18 defines a cylindrical surface which terminate at the forward end of the case 16 in a cone-shaped surface. The cylindrical and cone-shaped surfaces of the case 16 mate with similarly shaped surfaces of the ballast 20. While the bore 18 and ballast are described as having cylindrical and cone-shaped surfaces, any suitable shape can be employed. A bond interface zone 22 is defined by the mating surfaces of the case 16 and the ballast 20. The bond interface zone 22 includes copper (Cu) and silver (Ag), which is applied in a manner described more fully below.

In the preferred embodiment for making a penetrator, the case 16 is made of a high strength steel, such as 9Ni—4Co—.3C which has a tensile strength of 230,000 psi. Virtually any steel can be used in the present invention. The tungsten used to make the ballast 20 is preferably WHA, or tungsten heavy alloy, which is 95% tungsten and 5% nickel/iron binder.

Figure 2A:
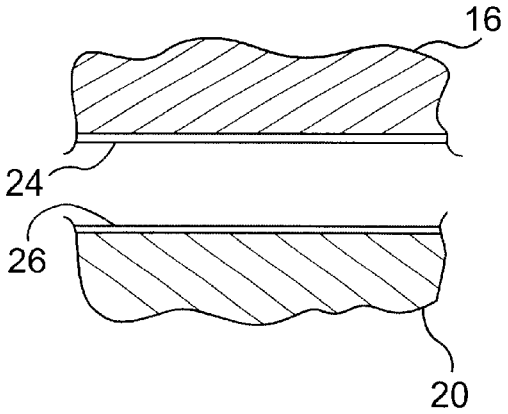
FIG. 2A is an enlarged, sectional view showing the process step of coating the mating surfaces of the tungsten ballast and steel casing prior to pressing.
Figure 2B:
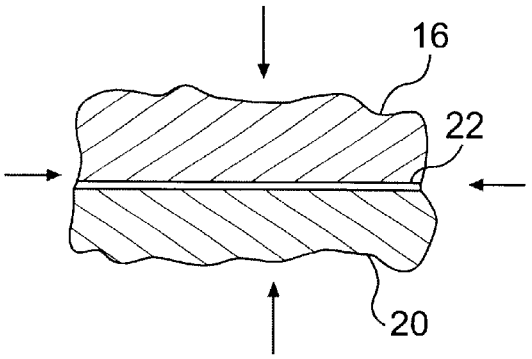
FIG. 2B is an enlarged, sectional view showing the mating surfaces in contact and pressure being applied to the structure.

Referring to FIGS. 2A and 2B, a method of forming a penetrator or other article begins with the steps of depositing first a copper coating on each mating surface, and then a silver coating. The coatings can be applied by any suitable means, such as electrolytic plating. A typical coating has a thickness range of 0.0001 to 0.001 inches. Preferably, the mating surfaces are cleaned of any contaminants or oxides before the coating step. The combined copper and silver coating 24 on the surface of case 16 and the combined copper and silver coating 26 on the surface of the ballast 26, are brought together by inserting the ballast into the bore 18 to form a close fit. The assembled ballast and case structure is then pressurized in a hot isostatic pressing (HIPing) step to form a diffusion bond between the steel and the tungsten.

In a typical HIPing process, the assembly is encapsulated, evaluated and sealed under vacuum in a metal can. The HIPing process used in the present invention applies a pressure sufficient to create a diffusion bond between the tungsten ballast and the steel case. Up to 50,000 psi has been used. The preferred range is 15,000 to 50,000 psi. As illustrated by the directional arrows, HIPing applies pressure in all directions. The pressure is applied at a temperature of between 900 and 1,100° F. These temperatures are less than the final tempering temperature of the steel, so that the ballast can be bonded to the steel case with the case previously in the fully heat treated condition. Because of extreme differences in density and thermo-coefficients of expansion, heat treating of the steel after a bonding cycle is impossible. Also, the preferred relatively low temperatures are less than the melting temperatures of the copper and silver, so that metallurgically sound diffusion occurs in the solid state. The time required to hold the assembly in the HIP can varies from product to product, and is generally selected to achieve a sufficient diffusion bond.

EXAMPLE 1

An assembly comprising a tungsten insert disposed in a high strength steel case was placed in a HIP apparatus after first coating the mating surfaces with copper and silver. The assembly was HIPed at 45,000 psi at a temperature of 1,000° F. for eight (8) hours. The bond joints at the interface of the tungsten and steel were measured for mechanical properties. The shear strength of the copper/silver coating formed on the tungsten to the copper/silver coating formed on the mating steel surface was 8.1 to 11.7 Ksi.

Other coatings were tested, including a copper coating formed on one surface, mated with a copper/silver coating of the mating surface. This produced a slightly weaker bond, but in several applications, the bond strength would be sufficient. Also, a copper coating mated with a copper coating produced a still weaker bond strength, although there may be applications were a lesser bond strength is sufficient. Accordingly, while the present invention preferably uses copper and silver deposited on each of the mating surfaces, one or both surfaces may have only copper as the deposited coating.

While the preferred embodiment was described with respect to penetrators, a variety of other articles can be made using the present invention. These articles could include any of those which may require a combination of tungsten and steel. An example would be steel and stainless steel golf club heads, where in the past tungsten was attached to steel by threads, shrink fit or brazing, While advantageous embodiments have been chosen to illustrate the invention, it will be understood by those skilled in the art that various changes and modifications can be made therein without departing from the scope of the invention as defined in the appended claims.

What is claimed is:

1. A method of making a penetrator comprising the steps of:

forming a tungsten ballast;

forming a steel casing with a bore sized to fit the tungsten ballast therein;

coating mating surfaces of the tungsten ballast and the steel casing with silver and copper;

fitting the tungsten ballast within the bore of the steel casing to form an assembly; and pressurizing the assembly at a pressure and temperature sufficient to form a diffusion bond between the tungsten ballast and the steel casing, wherein the bond temperature is below the final tempering temperature of the steel casing and the melting temperatures of the silver and copper.

2. A method according to claim 1, wherein the pressure is between about 15,000 and about 50,000 psi.

3. A method according to claim 1, wherein the pressurizing step includes hot isostatic pressing the assembly.

4. A method according to claim 1, wherein the tungsten ballast is made of a tungsten heavy alloy (WHA).

5. A method according to claim 4, wherein the WHA is about 95% tungsten and about 5% nickel and iron binder.

6. A method according to claim 1, wherein the coating step comprises electrolytically plating copper on the tungsten ballast to form a copper coating, followed by electrolytically plating silver on the copper coating to form a silver coating.

7. A method according to claim 6, wherein the coating step further comprises electrolytically plating copper on the steel case to form a copper coating, followed by electrolytically plating silver on the copper coating to form a silver coating.

* * * * *